United States Patent [19]

Meroni et al.

[11] Patent Number: 4,922,707

[45] Date of Patent: May 8, 1990

[54] DEVICE TO DISTRIBUTE SLIVER AUTOMATICALLY TO SPINNING MACHINES

[75] Inventors: Roberto Meroni; Fred Viol, both of Pordenone; Fabio Lancerotto, Milan; Umberto Gerin, Pordenone, all of Italy

[73] Assignee: Scaglia SpA, Brembilla, Italy

[21] Appl. No.: 337,377

[22] Filed: Apr. 13, 1989

[30] Foreign Application Priority Data

May 2, 1988 [IT] Italy ..... 83379 A/88

[51] Int. Cl.[5] ..... D01H 1/12; D01H 7/882

[52] U.S. Cl. ..... 57/408; 28/289; 57/90

[58] Field of Search ..... 57/90, 91, 400, 408, 57/409, 410–413; 19/157, 159 R, 159 A; 28/289–291

[56] References Cited

U.S. PATENT DOCUMENTS

| | | | |
|---|---|---|---|
| 4,022,007 | 5/1977 | Motobayashi et al. | 57/90 X |
| 4,078,369 | 3/1978 | Brandis | 57/90 X |
| 4,537,018 | 8/1985 | Tooka | 57/281 X |
| 4,735,040 | 4/1988 | Pircher | 19/159 A X |
| 4,809,495 | 3/1989 | Condotta | 57/408 |

FOREIGN PATENT DOCUMENTS

| | | |
|---|---|---|
| 0270164 | 6/1988 | European Pat. Off. . |
| 1510369 | 9/1970 | Fed. Rep. of Germany . |
| 2521851 | 11/1976 | Fed. Rep. of Germany . |
| 3440598 | 5/1986 | Fed. Rep. of Germany . |
| 2072043 | 9/1971 | France . |
| 86-06358 | 11/1986 | PCT Int'l Appl. . |
| 2171121 | 8/1986 | United Kingdom . |

*Primary Examiner*—John Petrakes
*Attorney, Agent, or Firm*—Wegner & Bretschneider

[57] ABSTRACT

A device which automatically distributes new sliver to spinning machines. The device includes movable units which run in a track along parallel banks of spinning machines stopping at the machines which need to be refilled. Generally, these units transport full cans of sliver from a storage facility to the specific empty spinning machine where the units feed the silver into the spinning machine by placing the end of the sliver into a feed conduit. The units then transport the empty can to a facility where it can be refilled.

19 Claims, 4 Drawing Sheets

DEVICE TO DISTRIBUTE SLIVER AUTOMATICALLY TO SPINNING MACHINES

This invention concerns a device to distribute sliver automatically to spinning machines. To be more exact, the invention concerns a device able to run along the working sides of spinning machines and suitable to fill with sliver the spinning cans which feed the spinning units when these cans are empty.

The device is applied advantageously to free-fibre spinning machines called "open-end spinning machines", but can also be employed, after suitable adaptations, on any spinning machine or other types of machines fed with sliver contained in cans.

The device according to the invention is also suitable to cooperate with organized storage areas of cans full of sliver and empty cans.

It is known that manual systems are still mainly employed in the field of spinning for conveying and positioning the cans holding slivers of fibres at the positions to feed the spinning units.

The full cans coming from intermediate stores or directly from the sliver production machines are handled by means of appropriate transport trolleys by personnel engaged in servicing the machines and positioned in the neighbourhood of the machines so as to form momentary storage areas.

In the same way the empty cans coming from the spinning machines follow the same path in the opposite direction.

In the case of open-end spinning machines, to which we shall refer in the description hereinafter without thereby setting a limit to the field of application of the invention, the machine operator employs full cans when those in use become empty.

The working methods to change the cans differ according to the type of machines, type of yarn, organization of the mill, etc.

Such methods, however, can be divided substantially into three types as follows:

- random change or replacement of an empty can at any position in the machine,
- change by sections or the successive replacement of a preset number of neighbouring cans,
- and change by machine or complete replacement of all the feed cans when the last one has been emptied.

All the above systems entail a plurality of problems linked substantially to the great quantity of sliver required to feed very fast machines such as open-end spinning machines and therefore to the need to handle great numbers of full and empty cans.

Moreover, spinning machines of the open-end spinning machine type have limited space available for feed cans and therefore these cans, even the ones having the biggest capacity, are limited in size and have a limited content of sliver to feed.

This leads to a frequent lack of sliver to feed, with a resulting necessity to replace empty cans with full cans.

Furthermore, the space required for stocks of cans is considerable, as also is the number of the cans themselves, which form a heavy cost for spinning mills.

Owing to their continual movement the cans become worn and are exposed to the risk of accidental damage, which leads to discards of cans.

Lastly, the handling of such a great quantity of cans generally requires a labour force employed for this purpose together with the resulting relative costs.

Automated systems to convey cans within the spinning mills have been proposed, but these systems are very expensive and particularly inflexible to apply.

Such embodiments provide systems able to convey cans from one store to another and/or to arrange replacement of empty cans with full ones at the spinning units, but these embodiments also entail considerable overall volumes and form hindrances for normal movement within the spinning mills.

The present applicant has designed, tested and embodied a device able to move along the side of a spinning machine or the sides of spinning machines and suitable to halt at a spinning unit which requires the device to fill a feed can with sliver when that can has been emptied.

The device consists of a movable unit which in the case of open-end spinning machines can run advantageously along the two sides of the machine in an endless circuit.

This movable unit comprises a central control body to which there are momentarily connected, on one side, a can coming from a drawing frame or another machine producing sliver and, on the other side, a can belonging to the spinning unit which is to be serviced.

The drawing frame can is very large and contains a great quantity of sliver, whence the central body of the device takes the sliver needed to fill a plurality of spinning cans. As is known, the latter are smaller in size as they have to be accommodated in a restricted space on the spinning machine.

The drawing frame can, which is firmly secured to the central body of the device while it moves along the spinning machine, is advantageously already taken full by the device from a store appropriately positioned and equipped in the spinning section or in a neighbouring position. This store in turn may be connected to the sliver production room.

When the sliver contained in the drawing frame can has been used up, the device itself removes that can and sends it to the storage area.

The central body of the device comprises also means for momentary cooperation with spinning cans, which are withdrawn from their working position on the spinning machine and are positioned in relation to the central body suitably to be filled with sliver taken from the drawing frame can.

When filled with sliver, the spinning cans are placed automatically again by the device in their working position on the spinning machine.

According to a variant the movable unit is able to move along the spinning machine and to take with it a spinning can, which is filled or partly filled with sliver substantially during this movement of the movable unit.

In this case the empty can to be replaced is taken from the spinning unit by the device of the invention, which at the same time arranges to place a full can in the same position on the spinning unit.

The empty can thus removed becomes the container for a new charge of sliver and for a subsequent replacement of an empty can with a full one on a movable unit requiring such replacement.

The central body of the device comprises means to rotate the drawing frame can while taking sliver from that can.

Means also included to indicate the presence of sliver in the drawing frame can, to engage the end of the sliver when the drawing frame can is full, and to transfer that end of the sliver to a distribution assembly.

The distribution assembly has the task of depositing the sliver in an orderly manner in the spinning can co-operating momentarily with the distribution assembly.

As we said earlier, means are connected to the central body which engage the spinning can and withdraw it from its relative position on the spinning machine so as to bring it to the sliver distribution assembly.

The device is equipped with elements suitable to identify the spinning units requiring servicing while the device is running along the sides of the spinning machine.

The device may also arrive at a spinning unit requiring servicing upon receipt of a summons from that unit, as may be possible when the device is controlled by a computer according to pre-set servicing programmes.

The attached figures, which are given as a non-restrictive example, show the following:

FIG. 1. gives a diagrammatic front view of an embodiment of the invention as applied to a spinning machine;

FIG. 2 shows a diagrammatic front view of some operational sequences of the invention of FIG. 1;

FIG. 3 gives a plan view of some details of FIG. 2;

Figure 1:
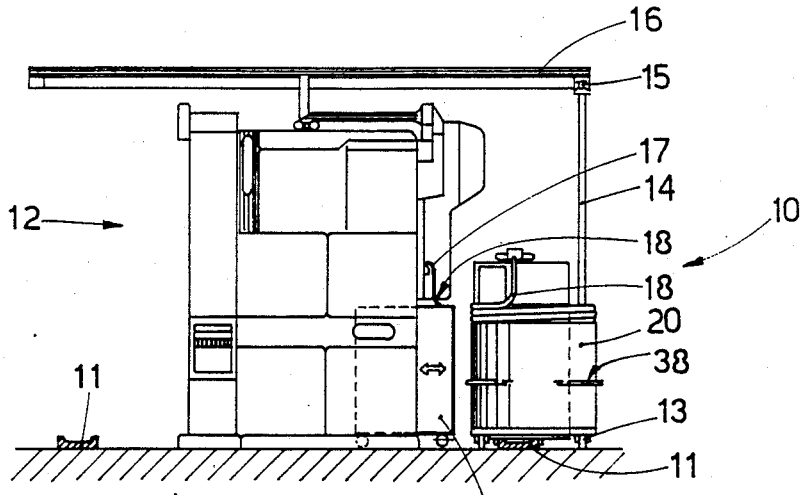

In the figures the device consists of a movable unit 10 able to run in this example on an appropriate rail 11 in the floor near the working sides of an open-end spinning machine 12.

The element 11 to guide the running of the movable unit 10 may be of various types included in the state of the art and may be positioned in different ways, even on the ceiling for instance.

The movable unit 10 is equipped at its lower end with means able to run, such as wheels 13, whereas it may bear at its upper end a shaft 14 able to slide on a guide 15 connected in turn to a service element 16 which conveys a motive force supply (electricity, compressed air, etc.) to the movable unit 10.

Each spinning unit 17 of the spinning machine 12 is fed with a sliver of fibres 18 held in a spinning can 19 suitably positioned at the respective spinning unit 17 in the lower part of the spinning machine 12.

In the state of the art the spinning can 19 generally comes from drawing frames which fill such types of can.

Figure 3:
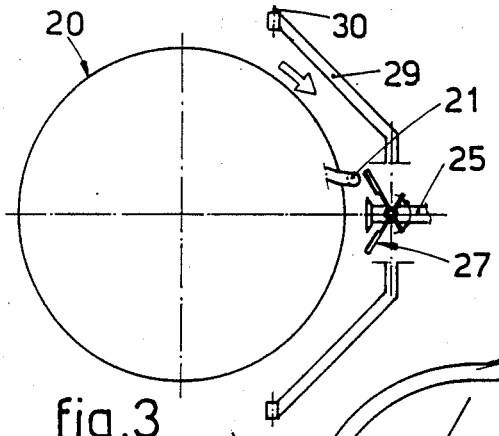

During its movement along the spinning machine 12 the movable unit 10 takes with it a large can 20 which is generally filled on appropriate drawing frames. This drawing frame can 20 is loaded when full on the movable unit 10 according to a working plan which will be illustrated hereinafter, an end 21 of the sliver 18 being pre-positioned outside the drawing frame can 20 (see FIGS. 2 and 3).

The first operations performed by the movable unit 10 on the sliver 18 are the search for and engagement of the end 21 of the sliver so as to deliver it to a distribution assembly 22, known in itself, which distributes the sliver 18 in the spinning can 19.

In the search for the end 21 of the sliver the drawing frame can 20 is rotated by rotation means 23 (see FIG. 5) located on the central body 24 of the movable unit 10.

During rotation of the drawing frame can 20 an aspiration intake 25 aspirates the end 21 of the sliver 18. the engagement of the end 21 being indicated by suitable sensor means, a photelectric cell 26 for instance.

Figure 2:
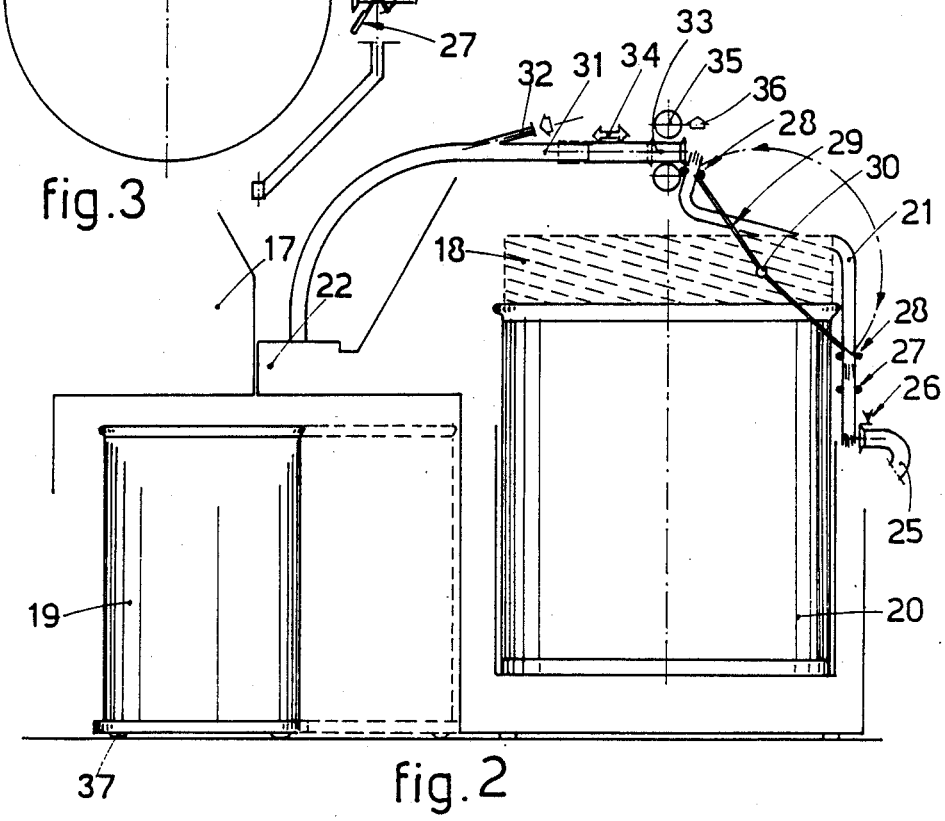

The photelectric cell 26 causes the closure of a first gripper assembly referenced with 27 in FIG. 2 and the simultaneous halting of rotation of the drawing frame can 20.

Thereafter a second gripper assembly 28 fitted to a support 29 able to oscillate about a pivot 30 closes on the end 21 of the sliver and begins rotating upwards, thus tearing the end 21 still held in the first gripper assembly 27.

The second gripper assembly 28 takes the end 21 of the sliver 18 to a conduit 31 kept in aspiration by means of an air injector 32.

The conduit 31 comprises an end portion 33 able to move in the direction of the arrow 34; this end portion 33 is caused to approach the torn end 21 of the sliver 18 released by the second gripper assembly 28.

The end 21 of the sliver is drawn into the distribution assembly 22, while the end portion 33 of the conduit 31 retreats and the sliver 18 is fed by a roller assembly 35.

The roller assembly 35 can be opened in the direction of the arrow 36 of FIG. 2 to enable the end portion 33 of the conduit 31 to approach the end 21 of the sliver 18.

The sliver 18 fed in this way fills the spinning can 19, which has previously been engaged by the movable unit 10 and is in the position for receiving the sliver 18 (shown with lines of dashes in FIG. 2).

If the spinning can 19 has a given size and shape, it can be handled by the movable unit 10 so that the sliver 18 is positioned correctly inside the spinning can during filling.

When withdrawal of the sliver 18 from the drawing frame can 20 has begun, the first gripper assembly 27 is opened to enable the aspiration intake 25 to aspirate the segment of sliver 18 still held in the first gripper assembly 27.

When the spinning can 19 has been filled, suitable monitoring means halt the depositing of sliver 18 and arrange for the latter to be torn, for instance by closure of the second gripper assembly 28.

The spinning can 19, which is equipped with its own means for movement such as wheels 37, is then re-positioned in its working position on the spinning machine 12.

Figure 4:
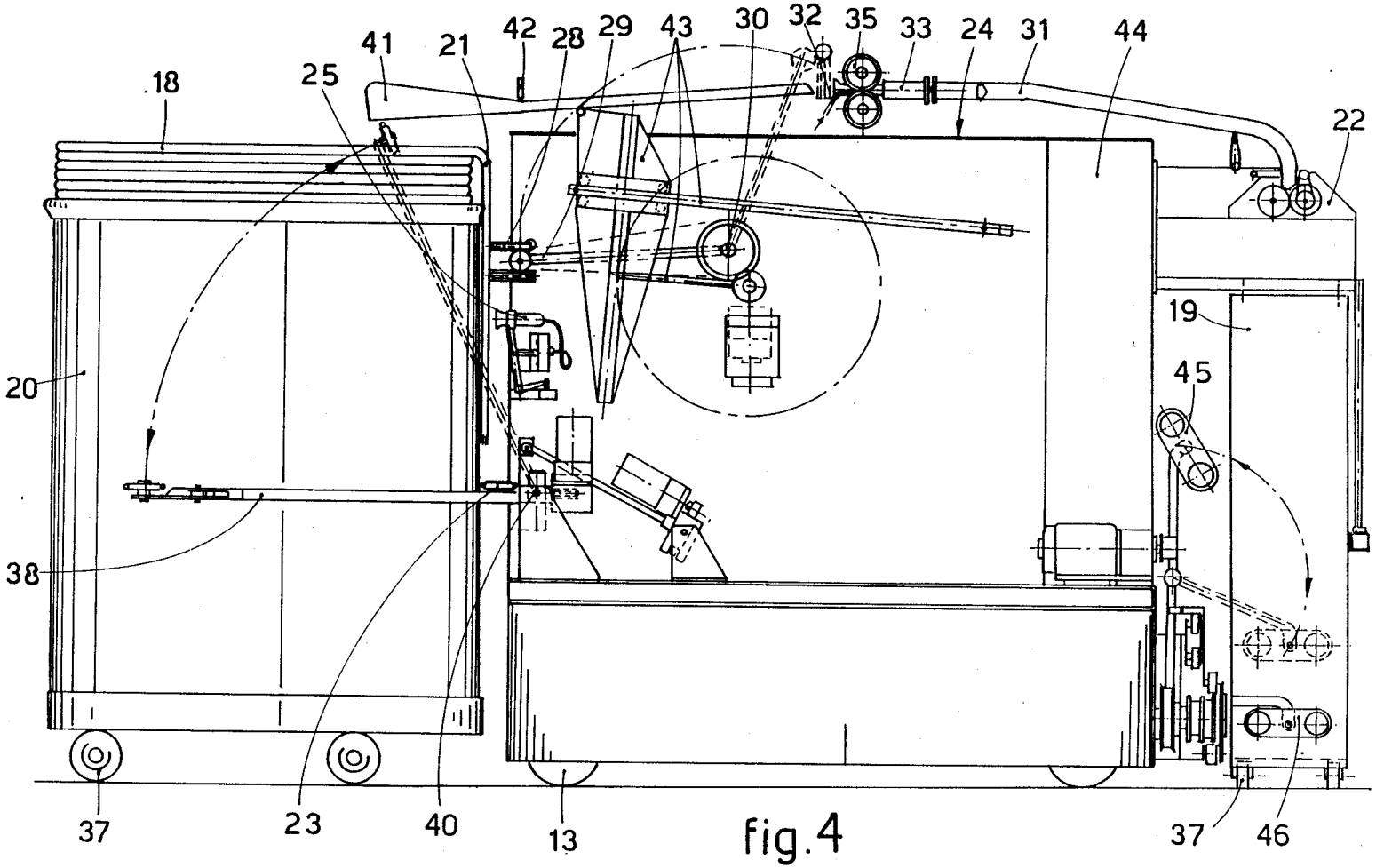
FIG. 4 shows a side view of a preferred embodiment of the invention.
Figure 5:
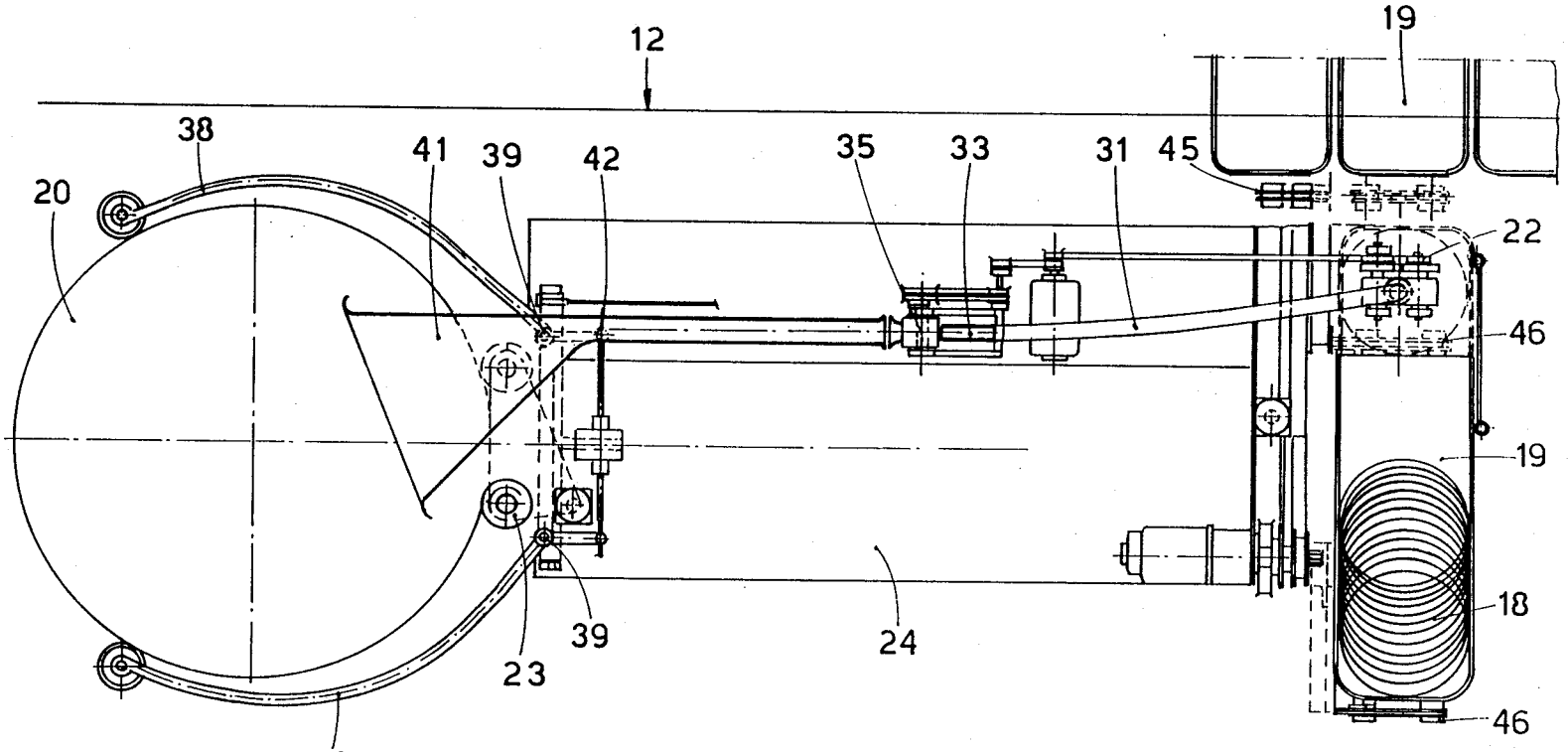
FIG. 5 is a plan view of the embodiment of FIG. 4.

FIGS. 4 and 5 show means 38 which engage and tow the drawing frame can 20 during its travel along the sides of the spinning machine 12. These engagement and towing means 38 can rotate about vertical pivots 39 and a horizontal pivot 40 so as to pass from their working positions (shown with continuous lines in FIG. 4) to their inactive positions (lines of dashes in FIG. 4) or to a position for release of the drawing frame can 20.

While being unwound from the drawing frame can 20, the sliver 18 is conveyed to the conduit 31 in a chute 41.

The presence of the sliver 18 in the chute 41 is monitored by a monitoring means such as a photoelectric cell 42.

The chute 41 is displaced by an actuation assembly 43 so as to enable the second gripper assembly 28 to rotate towards the conduit 31.

The central body 24 of the movable unit 10 comprises a space 44 to collect the segments of sliver 18 torn away during working.

The spinning cans 19 are moved in relation to their positions on the spinning machine 12 by an engagement and extraction assembly 45, which is caused to rotate to a position of cooperation with the spinning can 19 (position shown with lines of dashes in FIGS. 4 and 5) so as to take that can 19 from its position on the spinning machine 12.

An engagement and positioner assembly 46 thereafter takes the place of the engagement and extraction assembly 45 and has the task of taking the spinning can 19 to the distribution assembly 22 and possibly of displacing the spinning can 19 in relation to the distribution assembly 22 during the depositing of the sliver 18.

Figure 6:
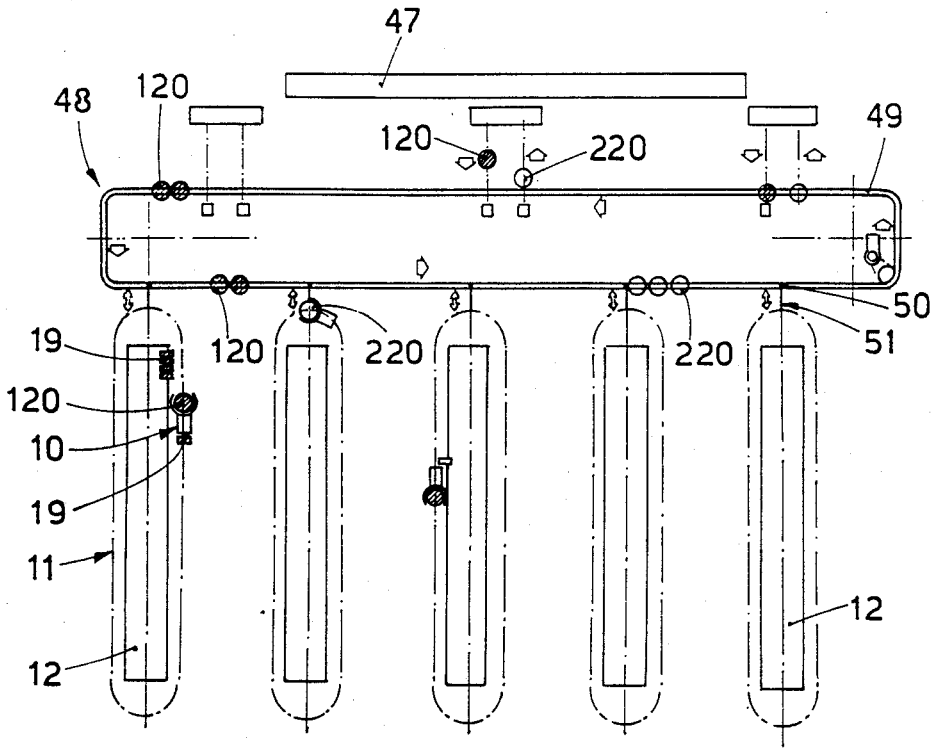
FIGS. 6 and 7 show two possible lay-outs of the spinning section.

FIG. 6 shows a possible lay-out of a spinning section with open-end spinning machines 12, each of which is serviced by movable units 10 according to the invention.

Between the section producing sliver, for instance a section containing drawing frames 47, and the spinning section is an area 48 for temporary storage of full and empty drawing frame cans, 120 and 220 respectively.

The full cans 120 coming from the drawing frame section 47 are sent on a movable circuit 49 which makes them pass one end of the spinning machines 12.

At that position is a junction 50, by which the full cans 120 are sent on a transfer path 51 connected to the path of the movable units 10 and are collected by the movable units 10 whenever this is signalled as being necessary.

In the same way the empty drawing frame cans 220 are released by the movable units 10 on the transfer path 51 and are sent through the junction 50 onto the movable circuit 49, which conveys them to the drawing frame section 47 for re-use.

Figure 7:
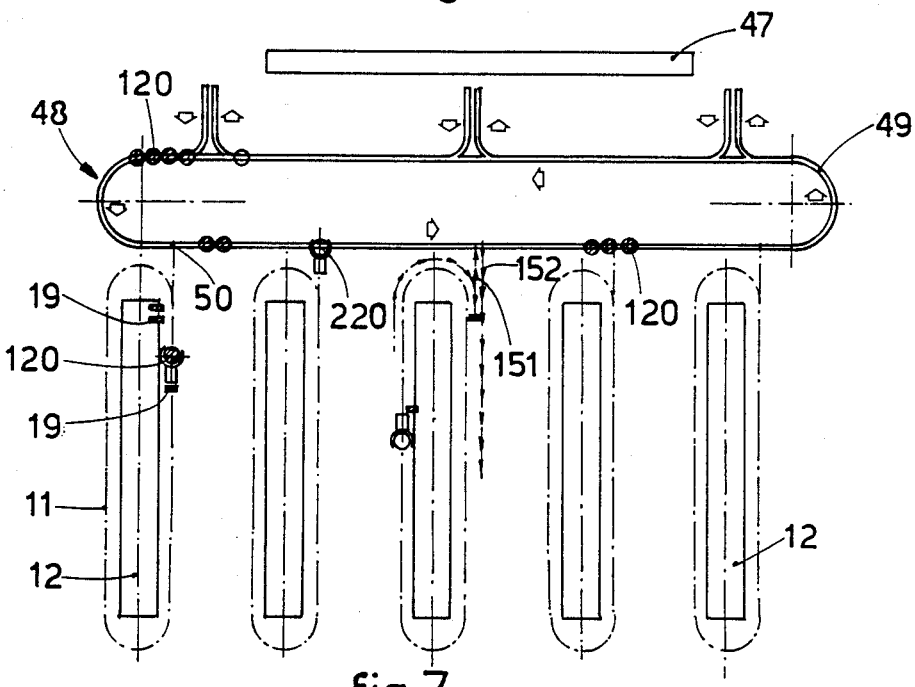

FIG. 7 shows a possible variant of the lay-out of FIG. 6, whereby the same movable units 10 take the empty cans 220 to the junctions 50 for removal and receive the full cans 120 arriving, in a manner analogous to that of the description of FIG. 6. In this case the movable units 10 will make outward 151 and return 152 journeys to and from the movable circuit 49.

We claim:

1. An apparatus to distribute sliver automatically to a plurality of spinning machines, each having a spinning can, the apparatus to distribute sliver comprising at least one movable unit , each of said at least one movable units comprising:

(a) drawing frame can containing sliver to be fed into said spinning can, (b) means for engaging and towing said drawing frame can, (c) sliver end engaging means for finding, engaging, and transferring an end of said sliver from said drawing can frame to a transferring means, (d) rotating means for rotating said drawing frame can at least during a period where the sliver end engaging means is finding the end of said sliver, so that said end of said sliver is brought to a circumferential position and gripped by said sliver end engaging means, (e) said transferring means receiving sliver from said sliver end engaging means and feeding said sliver into said spinning can, and (f) spinning can engaging means for extracting said spinning can from said spinning machine, positioning said spinning can so as to be in cooperation with said transferring means so that said spinning can may be refilled, and repositioning said spinning can in said spinning machine after said spinning can has been filled.

2. An apparatus to distribute sliver automatically to a plurality of spinning machines as claimed in claim 1, further comprising an endless circuit guide path means for guiding said at least one movable unit among said plurality of spinning machines.

3. An apparatus to distribute sliver automatically to a plurality of spinning machines as claimed in claim 2, further comprising a store of full drawing frame cans which said at least one moveable unit cooperates with to obtain a full drawing frame can.

4. An apparatus to distribute sliver automatically to a plurality of spinning machines as claimed in claim 3, wherein said store of full drawing frame cans cooperates with said endless circuit guide path means.

5. An apparatus to distribute sliver automatically to a plurality of spinning machines as claimed in claim 4, further comprising a store of empty drawing frame cans which said at least one moveable unit cooperates with to dispose of empty drawing frame cans.

6. An apparatus to distribute sliver automatically to a plurality of spinning machines as claimed in claim 5, wherein said store of empty drawing frame cans cooperates with said endless circuit guide path means.

7. An apparatus to distribute sliver automatically to a plurality of spinning machines as claimed in claim 2, wherein the endless circuit guide path means is disposed in a floor.

8. An apparatus to distribute sliver automatically to a plurality of spinning machines as claimed in claim 2, wherein the endless circuit guide path means is disposed in a ceiling.

9. An apparatus to distribute sliver automatically to a plurality of spinning machines as claimed in claim 1, wherein an actuating means for actuating said towing means, rotating means, sliver end engaging means, transferring means, and spinning can engaging means is disposed in a place external to each of said at least one movable units.

10. An apparatus to distribute sliver automatically to a plurality of spinning machines as claimed in claim 1, wherein each of said at least one movable units further comprises an actuating means for actuating said towing means, rotating means, sliver end engaging means, transferring means, and spinning can engaging means.

11. An apparatus to distribute sliver automatically to a plurality of spinning machines as claimed in claim 1, wherein said towing means cooperates momentarily with said drawing frame can.

12. An apparatus to distribute sliver automatically to a plurality of spinning machines as claimed in claim 1, wherein said sliver end engaging means further comprises an aspiration intake, a first gripper assembly, and a second gripper assembly, said first gripper assembly grips said end of said sliver after: (1) the drawing frame can has been rotated, (2) the end of said sliver has been brought to a circumferential position, and (3) said aspiration intake has positioned said end of said sliver; said second gripper assembly grips said sliver after said first gripper assembly has gripped said end of said sliver.

13. An apparatus to distribute sliver automatically to a plurality of spinning machines as claimed in claim 1, wherein said transferring means comprises:

a movable tube end portion for receiving an end of said sliver from said second gripper assembly, a conduit cooperating with said movable tube end portion for guiding said sliver to said spinning can, an air injector for aspirating said movable tube end portion and said conduit, and drawing rollers for moving said sliver through said movable end portion and said conduit.

14. An apparatus to distribute sliver automatically to a plurality of spinning machines as claimed in claim 13, wherein said drawing rollers are adapted to open a distance necessary to receive said movable end portion which is adapted to extend axially between said drawing rollers.

15. An apparatus to distribute sliver automatically to a plurality of spinning machines as claimed in claim 1, wherein said spinning can engaging means moves said spinning can while sliver is being deposited therein.

16. An apparatus for distribute sliver automatically to a plurality of spinning machines as claimed in claim 1, wherein said movable unit is controlled by a computer.

17. An apparatus to distribute sliver automatically to a plurality of spinning machines as claimed in claim 1, said spinning can having a support means for facilitating extraction from said spinning machine.

18. An apparatus to distribute sliver automatically to a plurality of spinning machines as claimed in claim 1, wherein said end of said sliver is prepositioned on the outside of said drawing frame can.

19. An apparatus for distribute sliver automatically to a plurality of spinning machines as claimed in claim 1, the sliver end engaging means having a photoelectric cell for detecting he end of said sliver.

* * * * *